US006484630B2

(12) United States Patent
Nakayama et al.

(10) Patent No.: US 6,484,630 B2
(45) Date of Patent: Nov. 26, 2002

(54) STENCIL PRINTING MACHINE

(75) Inventors: Koji Nakayama; Hideharu Yoneoka, both of Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/748,009

(22) Filed: Dec. 27, 2000

(65) Prior Publication Data

US 2001/0004866 A1 Jun. 28, 2001

(30) Foreign Application Priority Data

Dec. 28, 1999 (JP) ..... 11-377291

(51) Int. Cl.[7] ..... B41L 13/04; B41L 13/00; B41L 15/00

(52) U.S. Cl. ..... 101/116; 101/119; 101/114; 101/128; 101/120; 101/126

(58) Field of Search ..... 101/116, 119, 101/114, 120, 126

(56) References Cited

U.S. PATENT DOCUMENTS 5,517,913 A * 5/1996 Oshio et al. ..... 101/119
5,603,260 A * 2/1997 Ohinata et al. ..... 101/129
5,931,090 A * 8/1999 Ohkawa ..... 101/118
6,213,014 B1 * 4/2001 Motoe et al. ..... 101/116

FOREIGN PATENT DOCUMENTS

EP 0 678 395 10/1995

* cited by examiner

*Primary Examiner*—Daniel J. Colilla
*Assistant Examiner*—M P Crenshaw
(74) *Attorney, Agent, or Firm*—Nath & Associates PLLC; Gary M. Nath; Marvin C. Berkowitz

(57) ABSTRACT

A stencil printing machine 1 is provided with a stencil drum 16 and a opposite 17 which are a pair of cylindrical parts located with their external peripheral surfaces being close to each other, a stencil sheet 15 being detachably wound on the external peripheral surface of the stencil drum 16, and serves to perform stencil printing process by rotating the stencil drum 16 and the opposite 17 in order that the external peripheral surfaces thereof are located close to each other and moved in the same direction while the stencil sheet 15 is pressed against the opposite 17, and by making the stencil sheet 15 in contact under pressure with a sheet of paper 22 passing between the stencil drum 16 and the opposite 17 by the pressing force of the stencil drum 16. The stencil drum 16 is detachably mounted on the stencil printing machine and provided with storage units 201 to 203 for storing information about the pressing force of the stencil drum 16 against the opposite 17.

17 Claims, 12 Drawing Sheets

STENCIL PRINTING MACHINE

BACKGROUND OF THE INVENTION

1. Field of the Invention

The present invention relates to a stencil printing machine in which a stencil sheet wound on a stencil drum is pressed against a opposite which is located close to the stencil sheet, like a press of the internal pressing type, in order to perform stencil printing process.

2. Description of the Related Art

Existing stencil printing machines includes, for example, a type which is equipped with an internal pressing mechanisms. FIG. 1 is a schematic diagram representatively showing one example of the stencil printing machines of the prior art internal pressing type.

As illustrated in the same figure, the prior art stencil printing machine is composed of a printing mechanism 4 having a stencil drum 16 and a opposite 17 which are located with their external peripheral surfaces being close to each other inside of a machine body 50, a paper feed mechanism 5 serving to feed paper 22 as placed on a paper feed tray 23 to the printing mechanism 4, and a sheet discharge mechanism 6 serving to the printed paper 22 to a sheet discharge tray 34.

The stencil drum 16 as described above is provided with a stencil sheet wound on the external peripheral surface thereof. The stencil drum 16 is designed to be detachable from the machine body 50 in order that another stencil drum can substitute therefor in accordance with a desired color and so forth and that the stencil drum as detached can be used in another stencil printing machine.

Also, the stencil drum 16 is provided with an internal pressing roller 47 therein for outwardly pressing the internal peripheral surface of the stencil drum 16. The internal press roller 47 is linked with a printing press motor 48 through a spring 49 in order that the driving power of the printing press motor 48 is transmitted to the internal press roller 47 through the pressing force of the spring 49 to control the pressing force of the internal press roller 47 toward the internal peripheral surface of the stencil drum 16. The printing press motor 48 is driven by making use of a directive pulsed signal as selected. The pressing force of the internal press roller 47 can therefore be controlled by adjusting the directive pulsed signal.

In accordance with the configuration of such a conventional stencil printing machine, therefore, the external peripheral surface of the stencil drum 16 is moved together with the external peripheral surface of the opposite 17 located close thereto in the same direction during the rotation thereof, while the stencil sheet wound on the stencil drum 16 is pressed against the paper 22 passing between the stencil drum 16 and the opposite 17 by driving the printing press motor 48 in accordance with the directive pulsed signal as selected, so that an image formed on a stencil sheet is printed onto the paper 22 in accordance with the stencil printing mechanism.

However, in the case of the conventional stencil printing machine as described above, the respective stencil drum and the respective machine body can be endued with dispersed characteristics due to the dispersion of the accuracy of setting the stencil drum 16 and the printing mechanism 4 and so forth.

Accordingly, in the case that another stencil drum can substitute for the stencil drum 16 or that the stencil drum 16 as detached is used in another stencil printing machine as described above, a desired pressing force can no longer be obtained, even when the printing press motor 48 is driven with the same directive pulsed signal because of the dispersion of the characteristics as described above, resulting in dispersion of printed images whose densities become sometimes low and sometimes high.

Namely, for example, in the case that the stencil drum 16 is replaced with a stencil drum 16' as illustrated in FIG. 3, the pressing force against the stencil drum 16' deviates from a desired value due to an error $d\theta$ in the driving angle of the internal press roller 47 so that the image as printed with the stencil drum 16' is different than that as printed with the stencil drum 16 because of the differential accuracy of setting the stencil drums.

The present invention has been made in order to solve the shortcomings as described above. It is an object of the present invention to provide a stencil printing machine capable of preventing the printing quality of images from being dispersed due to the dispersion of the accuracy of setting the respective stencil drums and the like.

SUMMARY OF THE INVENTION

In order to solve the problems as described above, a stencil printing machine recited in claim 1 comprises a stencil drum and a opposite which are a pair of cylindrical parts located with their external peripheral surfaces being close to each other, a stencil sheet being detachably wound on the external peripheral surface of said stencil drum, and serving to perform stencil printing process by rotating said stencil drum and said opposite in order that the external peripheral surfaces thereof are located close to each other and moved in the same direction while said stencil sheet is pressed against said opposite, and by making said stencil sheet in contact under pressure with a sheet of paper passing between said stencil drum and said opposite by the pressing force of said stencil drum, wherein said stencil drum is detachably mounted on said stencil printing machine and provided with a storage unit for storing information about the pressing force of said stencil drum against said opposite.

In accordance with the present invention as recited in claim 1, it is possible to prevent the pressing force from varying due to dispersed characteristics of the stencil drums which are caused by the dispersion of the accuracy of setting the stencil drum and so forth. Namely, the information about the respective pressing forces of the respective stencil drum is stored in the storage unit provided for the respective stencil drum and is used for adjusting the printing press as applied. It is therefore possible to prevent printed images from being lightened or darkened.

Also, a stencil printing machine recited in claim 2 comprises a stencil drum and a opposite which are a pair of cylindrical parts located with their external peripheral surfaces being close to each other, a stencil sheet being detachably wound on the external peripheral surface of said stencil drum, and serving to perform stencil printing process by rotating said stencil drum and said opposite in order that the external peripheral surfaces thereof are located close to each other and moved in the same direction while said stencil sheet is pressed against said opposite, and by making said stencil sheet in contact under pressure with a sheet of paper passing between said stencil drum and said opposite by the pressing force of said stencil drum, wherein said stencil drum is detachably mounted on said stencil printing machine and wherein a machine body of said stencil printing machine is provided with a storage unit for storing information about the pressing force of said opposite against said stencil drum.

In accordance with the present invention as recited in claim 2, it is possible to prevent the pressing force from varying due to dispersed characteristics of the stencil printing machines which are caused by the dispersion of the accuracy of setting the printing mechanism of the stencil printing machine and so forth. Namely, the information about the respective pressing forces of the respective stencil printing machines are stored in the storage unit provided for the respective stencil printing machines and is used for adjusting the printing press as applied. It is therefore possible to prevent the qualities of the printed images from being dispersed.

Furthermore, in accordance with the present invention as recited in claim 3, a stencil printing machine recited of claim 2 further comprises a standard pressing force determination unit for determining a standard pressing force; a correction value calculation unit for calculating a correction value by the use of the information about the pressing force as stored in said stencil drum and the information about the pressing force as stored in said machine body; and a calculation unit for calculating the pressing force by the use of said standard pressing force and said correction value.

In accordance with the present invention as recited in claim 3, while standard pressing forces are determined, the correction is conducted by the use of the correction values calculated with respect to the standard pressing forces for the respective stencil printing machines and the respective stencil drums. It is therefore possible to prevent the printing press as applied from being dispersed due to the dispersion of the characteristics of the individual stencil printing machines and the individual stencil drums even when an arbitrary combination of one of the stencil printing machines and one of the stencil drums is used.

BRIEF DESCRIPTION OF THE DRAWINGS

FIG. 11(*b*) is a flowchart showing the operation of the main control section of the stencil drum in accordance with the embodiment of the present invention.

DESCRIPTION OF THE PREFERRED EMBODIMENT

Hereinbelow, a preferred embodiment of the stencil printing machine in accordance with the present invention will be explained in conjunction with the accompanied drawings.

(The Overall Configuration of the Stencil Printing Machine)

Figure 1:
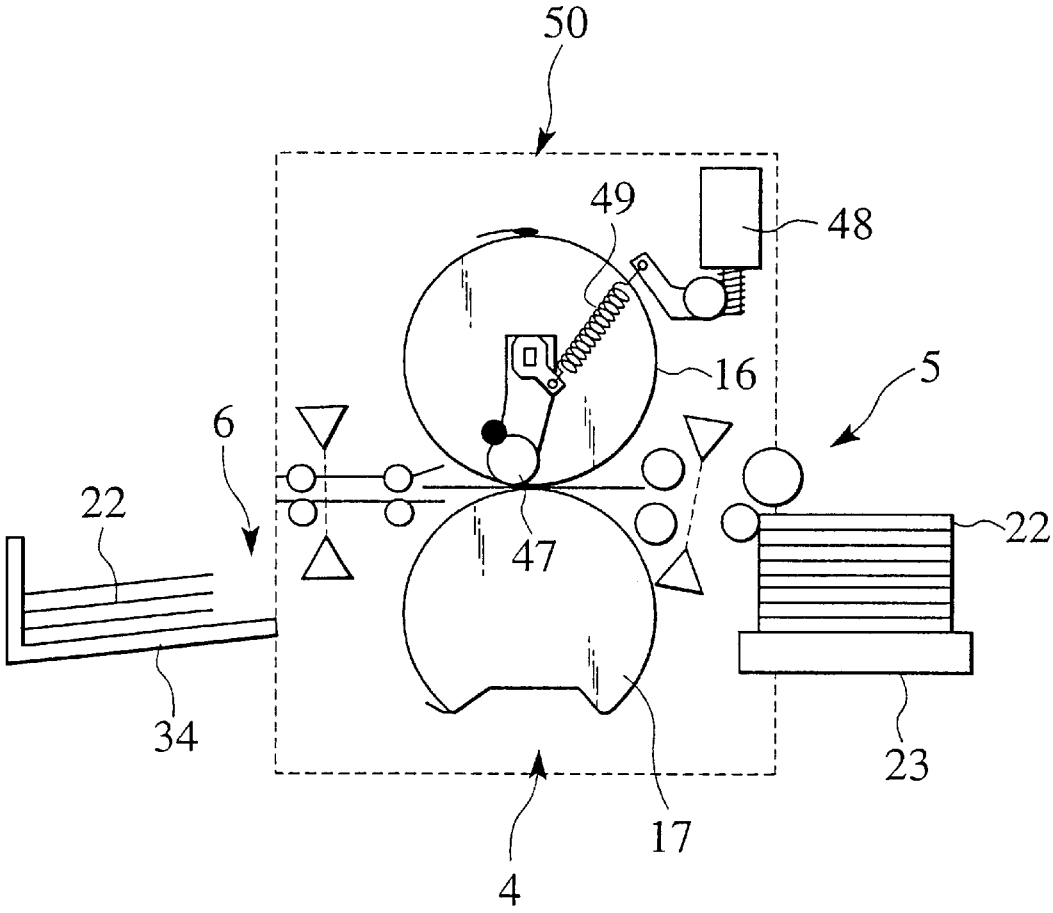
FIG. 1 ( PRIOR ART )
FIG. 1 is a schematic diagram representatively showing the overall configuration of a conventional stencil printing machines.
Figure 2:
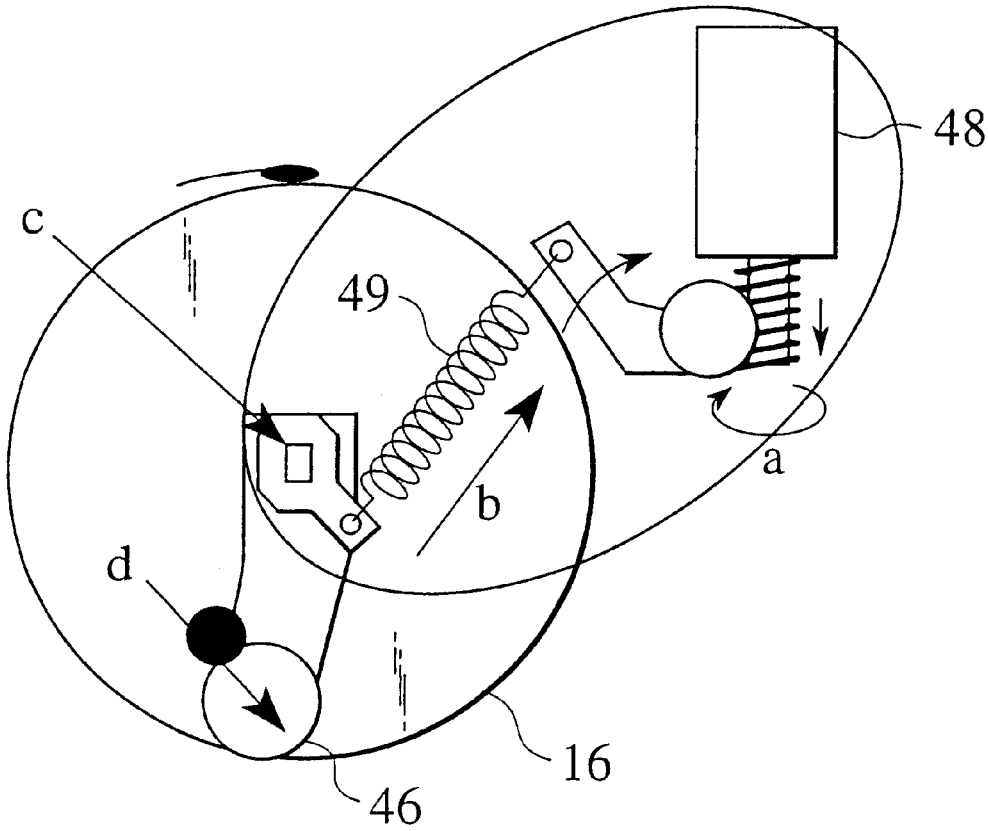
FIG. 2 ( PRIOR ART )
FIG. 2 is an explanatory view for showing the configuration of the stencil drum mechanism of the conventional stencil printing machines.
Figure 3:
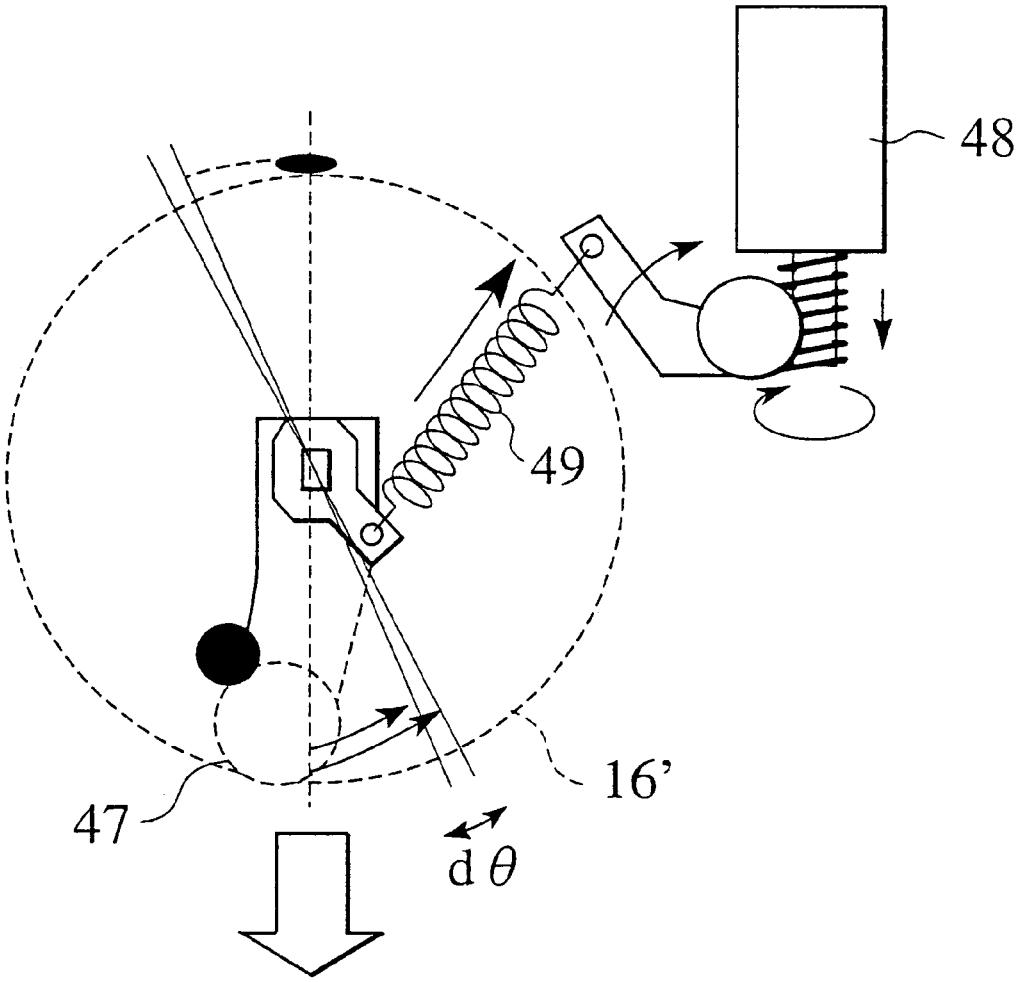
FIG. 3 ( PRIOR ART )
FIG. 3 is an explanatory view for showing the operation of the stencil drum mechanism of the conventional stencil printing machines.
Figure 4:
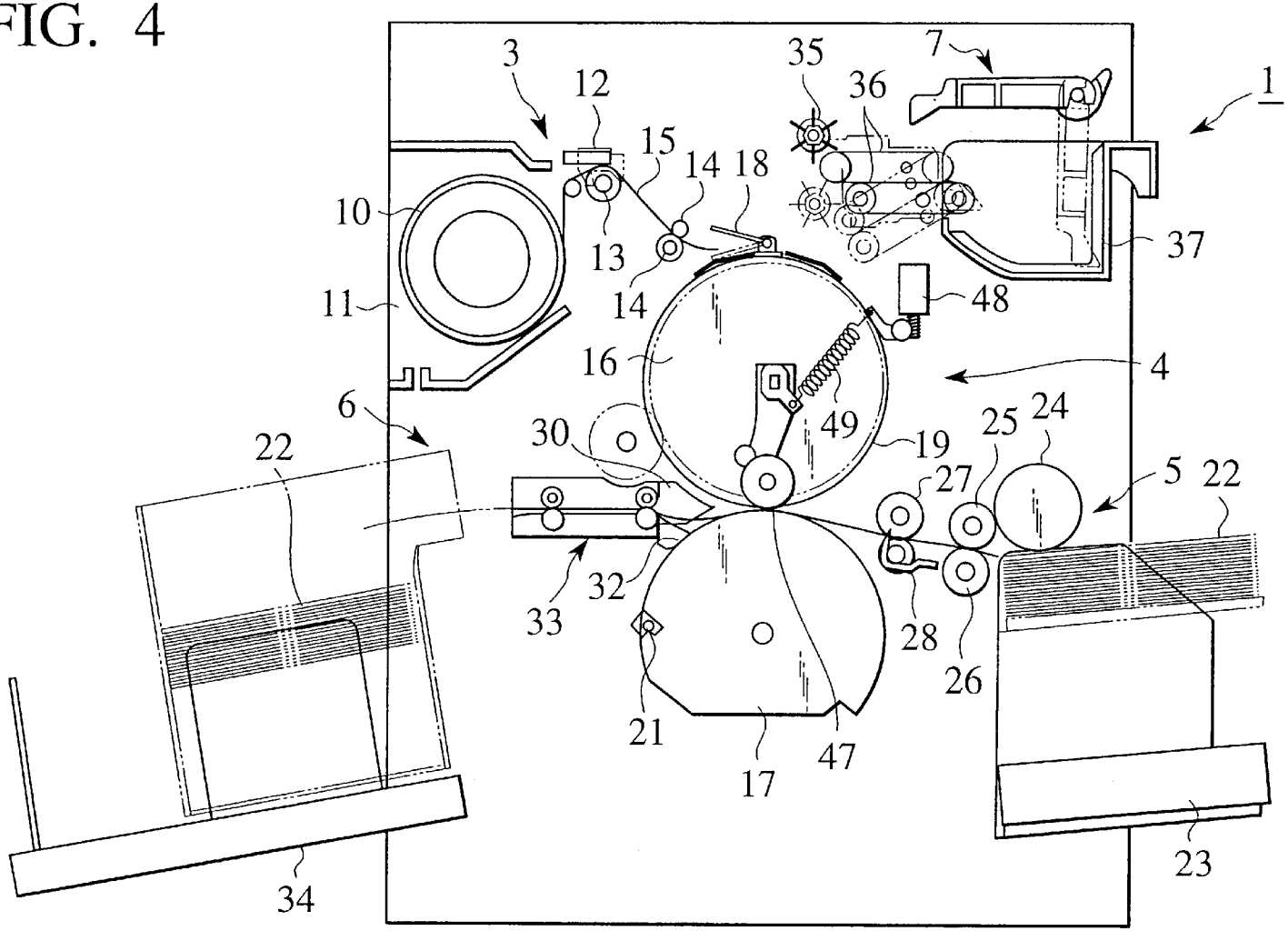
FIG. 4 is a schematic cross section view showing the entire configuration of the stencil printing machine in accordance with an embodiment of the present invention.

FIG. 4 is a schematic cross section view showing the internal configuration of the stencil printing machine 1 in accordance with the present embodiment. In the figure, the stencil printing machine 1 is composed mainly of a document reading mechanism (not shown in the figure), a stencil making mechanism 3, a printing mechanism 4, a paper feed mechanism 5, a paper discharging mechanism 6 and a stencil discharging mechanism 7.

The document reading mechanism (not shown in the figure) serves to read original documents in the form of electric signals. The information as read is formatted to accept predetermined instructions such as expansion, reduction and so forth.

The stencil making mechanism 3 serves to make a stencil sheet from continuous stencil paper 10 on the basis of the electric signal as read by means of the document reading mechanism and is composed of a stencil paper holder 11, a thermal head 12 located in the downstream side of the feeding direction of the continuous stencil paper 10, a platen roller 13 located in the opposite side to the thermal head 12, a pair of stencil feeding rollers 14 located in the downstream side of the feeding direction of the continuous stencil paper 10, and a stencil cutter (not shown in the figure) located between the pair of the stencil feeding rollers 14 and the platen roller 13.

The printing mechanism 4 is provided with the stencil drum 16 and the opposite 17 which are supported to rotate with the respective external peripheral surfaces thereof located close to each other. The stencil drum 16 is provided with a pair of cylindrical flanges (not shown in the figure) located opposite to each other with a predetermined distance. A stencil clamp 18 is provided at the external peripheral surface of the flanges for clamping the leading edge of the stencil sheet 15.

A flexible screen 19 forming the external peripheral wall of the stencil drum 16 is stretched on the external peripheral surface of the flanges of the stencil drum 16 where the stencil clamp 18 is not located. The internal press roller 47 is located inside of the screen 19 of the stencil drum 16 as part of an internal press mechanism 20, A paper clamp 21 is provided at a predetermined location of the external peripheral surface of the opposite 17 for clamping the leading edge of a printing sheet 22.

The paper feed mechanism 5 is composed of a paper feed tray 23 in which a number of the printing sheet 22 are stacked as a printing medium, a scraper 24 for coming into abrasive contact with the uppermost sheet of the printing sheets 22 on the paper feed tray 23, a picking up roller 25 and a separating roller 26 which are located close to each other in the downstream side of the scraper 24, and a guide roller 27 and a timing roller 28 which are located close to each other in the downstream side of the picking up roller 25 and the separating roller 26.

The printing sheet 22 is transported to the picking up roller 25 and the separating roller 26 by the rotation of the scraper 24. Any lower sheet other than the uppermost sheet 22 is not allowed to be transported by means of the picking up roller 25 and the separating roller 26. The uppermost printing sheet 22 is transported by the rotation of the guide roller 27 and the timing roller 28 in synchronism with the rotation of the opposite 17.

The paper discharging mechanism 6 is composed of an upper blocking guide member 30 for guiding the leading edge of the printing sheet 22 after printing, a printing sheet separating hook 32 for peeling off the printing sheet 22 adhering to the opposite 17, a printing sheet transportation mechanism 33 for transporting the printing sheet 22 which is guided by the upper blocking guide member 30 or coming off from the opposite 17 by means of the printing sheet separating hook 32, and a stacking tray 34 for accommodating a stack of the printing sheets 22 as transported by means of the printing sheet transportation mechanism 33.

The stencil discharging mechanism 7 is composed of a stencil discharging guiding belt 35 for guiding the leading edge of the stencil sheet 15 which is released from the stencil clamp 18 of the stencil drum 16, a pair of stencil discharging transportation belts 36 for transporting the stencil sheet 15 which is peeled off from the stencil drum 16 and guided by the stencil discharging guiding belt 35, and a discharged stencil box 37 for storing the stencil sheet 15 transported by means of the pair of the stencil discharging transportation belts 36.

(The Operation of the Stencil Printing Machine)

Next, the operation of the stencil printing machine 1 as described above will be briefly explained. The stencil making mechanism 3 serves to transport the continuous stencil paper 10 by the rotation of the platen roller 13 and the stencil feeding roller 14, and heat-sensitively perforate the continuous stencil paper 10 by selectively activating the respective heating elements of the thermal head 12 on the basis of image information obtained by means of the document reading mechanism (not shown in the figure), followed by cutting the continuous stencil paper 10 with an exact size corresponding to one stencil sheet to obtain the stencil sheet 15.

The printing mechanism 4 serves to clamp the leading edge of the stencil sheet 15 as prepared by the stencil making mechanism 3 by means of the stencil clamp 18 of the stencil drum 16, which, in turn, rotates with the stencil sheet 15 being clamped in order to mount the stencil sheet 15 by winding the stencil sheet 15 on the screen 19 forming the external peripheral wall of the stencil drum 16.

The paper feed mechanism 5 serves to transport the printing sheet 22 in synchronism with the rotation of the stencil drum 16 and the opposite 17 and to pass the printing sheet 22 with the leading edge thereof being clamped by means of the paper clamp 21 of the opposite 17 through between the stencil drum 16 and the opposite 17.

On the other hand, the internal press roller 47 is located in the stand-by position apart from the screen 19 in the printing mechanism 4 when the actual printing operation is not performed. When the actual printing operation is performed, the internal press roller 47 is pressed against the stencil drum 16 while the stencil drum 16 is rotated. The internal press roller 47 then rotates on the internal peripheral surface of the screen 19 while the internal peripheral surface of the screen 19 is outwardly pressed by the internal press roller 47 aside of the peripheral position of the stencil clamp 18. Since the external peripheral surface of the internal press roller 47 is continuously supplied with ink 53, this rotation causes the ink 53 to be transferred to the screen 19.

Also, the screen 19 is expanded in the radial direction under the pressing force of the internal press roller 47 so that the screen 19 is in contact with and pressed against the opposite 17. The printing sheet 22 is passed through between the stencil drum 16 and the opposite 17 by means of the paper feed mechanism 5 as described above, and then pressed between the internal press roller 47 and the opposite 17 together with the screen 19 and the stencil sheet 15.

During the pressing transportation process, the ink 53 is transferred through the perforation of the stencil sheet 15 to transcribe the image information to the printing sheet 22. When the leading edge of the printing sheet 22 is passed through the internal press roller 47 to the downstream side thereof, the paper clamp 21 is released.

The paper discharging mechanism 6 serves to guide the leading edge of the printing sheet 22 by means of the upper blocking guide member 30 or to peel off the leading edge of the printing sheet 22 adhering to the opposite 17, followed by transporting the printing sheet 22 to the stacking tray 34 by means of the printing sheet transportation mechanism 33.

Meanwhile, when a new stencil sheet is to be made, the stencil discharging mechanism 7 serves to discharge the previous stencil sheet 15, as a used sheet, wound on the external peripheral surface of the screen 19 of the stencil drum 16. In this case, the leading edge of the stencil sheet 15 is released from the stencil clamp 18 of the stencil drum 16, then guided by means of the stencil discharging guiding belt 35 with the stencil drum 16 being rotated, transported to the discharged stencil box 37 by means of the pair of the stencil discharging transportation belt 36 and stored in the discharged stencil box 37.

(The Configuration of the Main Control Section and the Stencil Drum Control Section)

Figure 5:
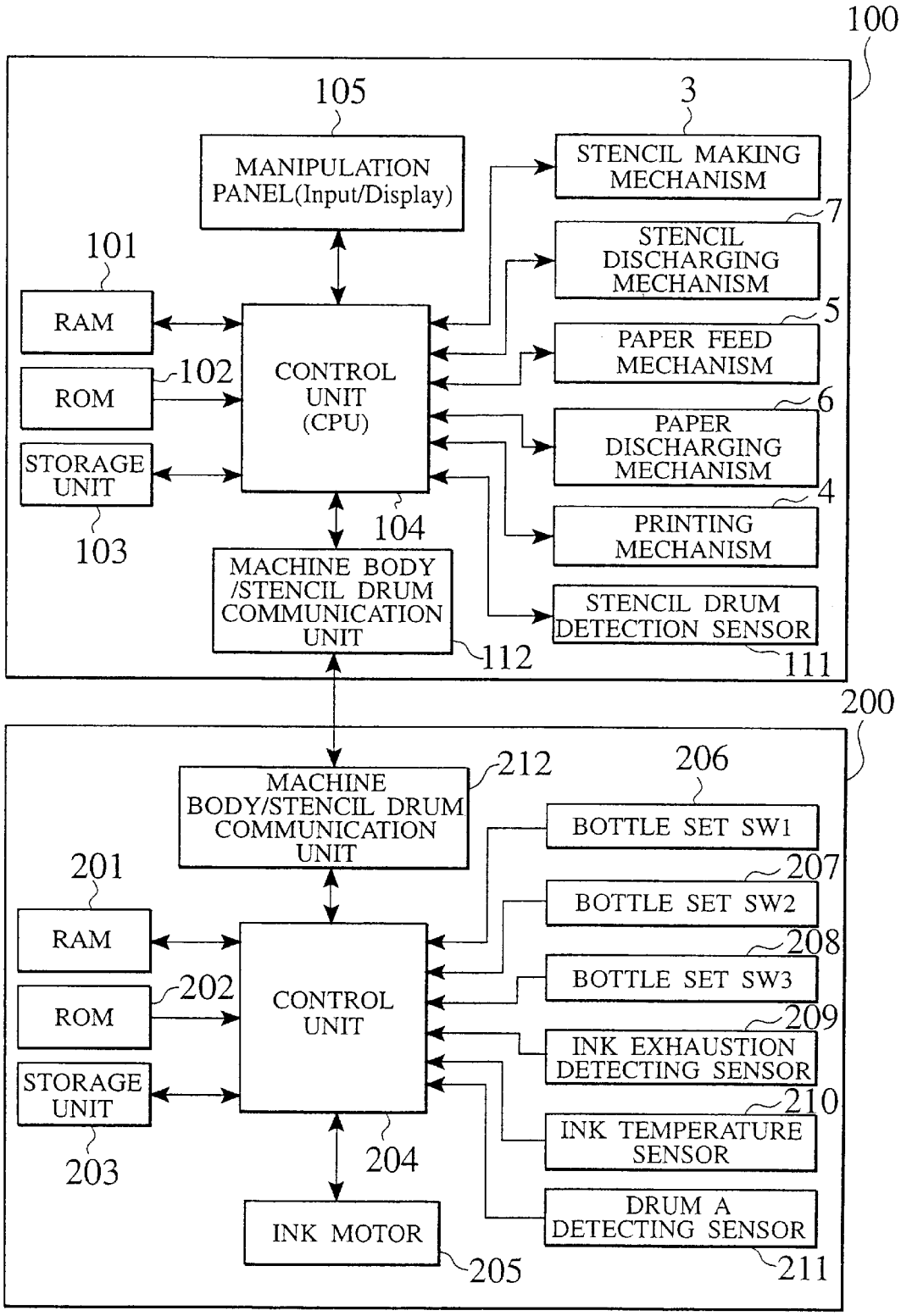
FIG. 5 is a block diagram schematically showing the configuration of the main control section and the stencil drum control section in accordance with the embodiment of the present invention.

The stencil printing machine 1 in accordance with the present embodiment is provided with a main control section 100 in the machine body for controlling the entire operation of the stencil printing machine 1 and a stencil drum control section 200 in the stencil drum 16 for controlling the operation of the stencil drum 16. FIG. 5 is a block diagram schematically showing the configuration of the main control section 100 and the stencil drum control section 200.

As illustrated in the same figure, the main control section 100 is composed of a control unit (CPU) 104, as a center of the main control section 100, for taking control of the respective mechanisms of the stencil printing machine 1 (i.e.,the stencil making mechanism 3, the stencil discharging mechanism 7, the paper feed mechanism 5, the paper discharging mechanism 6, the printing mechanism 4 and so forth), a RAM 101, a ROM 102 and a storage unit 103 which are provided for preserving a variety of data items for retrieval, a manipulation panel 105 serving to provide an interface for receiving information to be given to the control unit 104 and for displaying several indications required for manipulation as display means, a stencil drum detection sensor 111 for determining the existence of the stencil drum 16, a machine body/stencil drum communication unit 112 for exchanging data between the machine body of the stencil printing machine 1 and the stencil drum 16.

The RAM 101, the ROM 102 and the storage unit 103 serve to store data required for the operation conducted by the control unit 104 and the result of the operation, particularly, serve to store a data table for use in calculating a standard operation quantity of the printing press motor. The stencil drum detection sensor 111 serves to monitor the existence of the stencil drum 16, which is detachable and therefore sometimes separated from the machine body.

On the other hand, the stencil drum control section 200 is composed of a control unit (CPU) 204 for taking control of bottle sets SW206 to SW208 provided for the stencil drum 16, a number of sensors (an ink exhaustion detecting sensor 209, an ink temperature sensor 210, a drum A detecting sensor 211 and so forth) and an ink motor 205, a machine body/stencil drum communication unit 212 for exchanging data between the machine body of the stencil printing machine 1 and the stencil drum 16.

The RAM 201, the ROM 202 and the storage unit 203 serve to store data required for the operation conducted by the control unit 204 and the result of the operation, particularly, serve to store a stencil drum printing press correction value Td for use in calculating the operation quantity T of the printing press motor 48. The drum A detecting sensor 211 serves to detect the position at which the drum is to stop.

(Calculation of the Operation Value of the Printing Press Motor)

Figure 6:
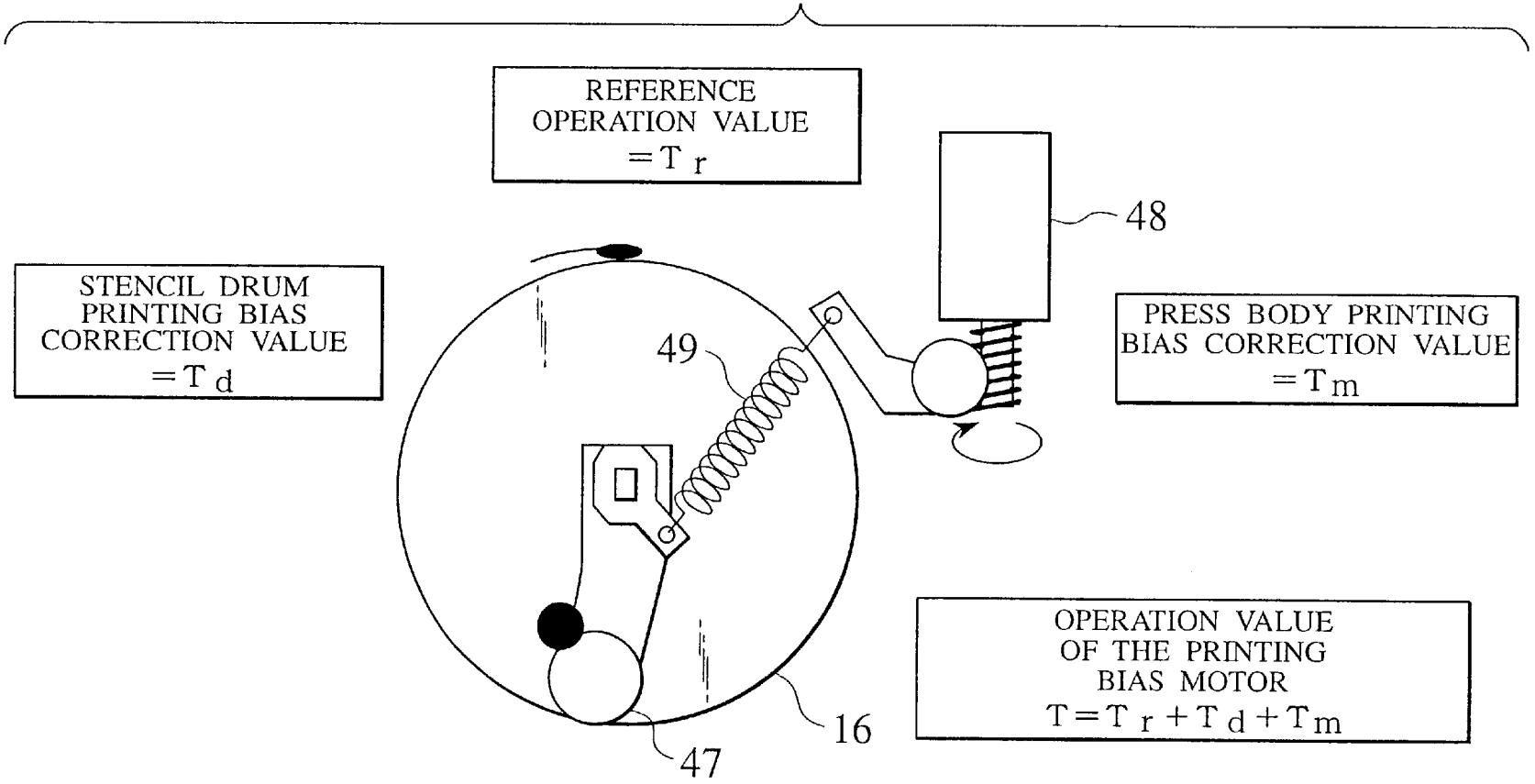
FIG. 6 is an explanatory view for showing showing the calculation of correction of the operation quantity of the printing press motor in accordance with the embodiment of the present invention.

The operation quantity of the printing press motor will be explained in the following description. FIG. 6 is a block diagram schematically showing the calculation of the standard operation quantity. As described above, the printing press is applied to the stencil drum 16 by means of the printing press motor 48 located in the machine body 1 as the pressing force of the internal press roller 47 located in the stencil drum 16. Namely, the printing press motor 48 is controlled by the pulsed signal and generates driving power to the internal press roller 47 through the spring 49 to control the pressing force of the internal press roller 47 against the internal surface of the stencil drum 16. In accordance with the present embodiment, the operation quantity T [pulse] of the printing press motor 48 is determined by the standard operation quantity Tr, the stencil drum printing press correction value Td and the machine body printing press correction value Tm.

The standard operation quantity Tr is determined by the printing speed and the printing density which are required by a user and the temperature of the stencil drum when printing. More specifically speaking, an appropriate operation quantity is calculated with standard to the data table stored in the storage unit 103 and the like to be the printing speed and the printing density which are input through the manipulation panel 105 by a user or which have been preset before shipping from a factory.

Next, when the standard operation quantity Tr as required of the printing press motor 48 has been determined on the basis of the printing speed, the printing density and the temperature of the stencil drum, the correction control is conducted by adding the stencil drum printing press correction value Td and the machine body printing press correction value Tm to the standard operation quantity Tr.

In this case, the stencil drum printing press correction value Tm is obtained experimentally and heuristically as a correction value corresponding to the deviation of the operation quantity of the printing press motor 48 for generating the standard printing press from the standard operation quantity. The stencil drum printing press correction value Tm is preset before shipping or set in the course of maintenance afterward.

Figure 7:
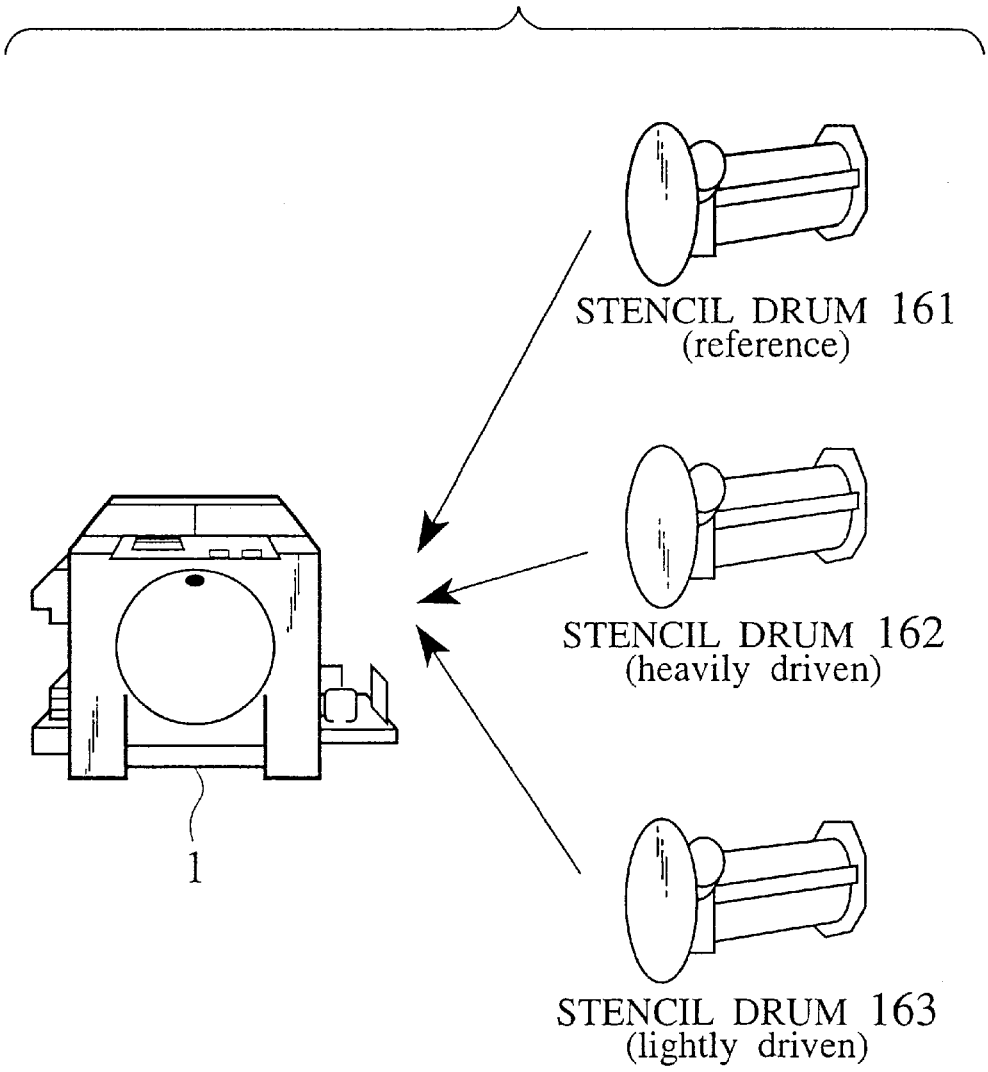
FIG. 7 is an explanatory view for explaining the stencil drum printing press correction value in accordance with the embodiment of the present invention.

For example, as illustrated in FIG. 7, when a plurality of the stencil drums 161 to 163 are prepared for use in the stencil printing machine 1, a directive pulsed signal X is determined as the standard directive pulsed signal X with which the printing press motor 48 is driven to produce a printing press force of 5 kg against the opposite 17 in the case that the stencil drum 161 is mounted on the stencil printing machine 1. On the other hand, if the printing press motor 48 is driven to produce a printing press force of 5 kg against the opposite 17 with a directive pulsed signal (X+20) in the case that the stencil drum 162 is mounted on the stencil printing machine 1, the deviation of +20 is determined as the stencil drum printing press correction value Td of the stencil drum 162. Also, if the printing press motor 48 is driven to produce a printing press force of 5 kg against the opposite 17 with a directive pulsed signal (X−20) in the case that the stencil drum 163 is mounted on the stencil printing machine 1, the deviation of −20 is determined as the stencil drum printing press correction value Td of the stencil drum 163.

Furthermore, the machine body printing press correction value Tm is a value which is to be stored in the storage unit 103 of the main control section 100 and the like and obtained for example by experiments as an average standard value which is obtained corresponding to the deviation of the operation quantity of the printing press motor 48 for generating the standard printing press from the standard operation quantity. The stencil drum printing press correction value Tm is for example preset before shipping for each stencil printing machine.

Figure 8:
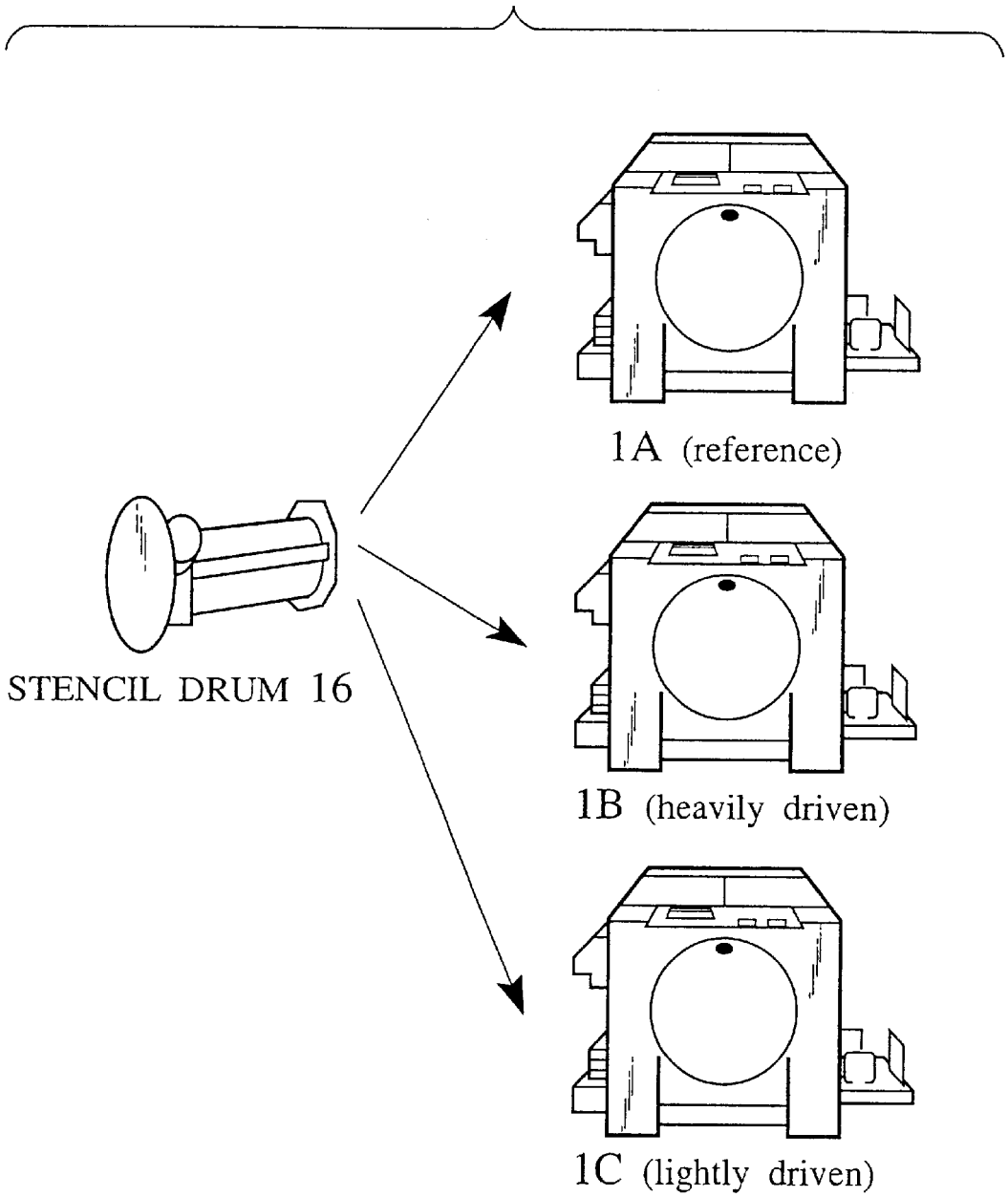
FIG. 8 is an explanatory view for explaining the machine body printing press correction value in accordance with the embodiment of the present invention.

For example, as illustrated in FIG. 8, a directive pulsed signal X is determined as the standard machine body printing press correction value Tm for the stencil printing machine 1A with which the printing press motor 48 is driven to produce a printing press force of 5 kg against the opposite in the case that the stencil drum 16 is mounted on said each stencil printing machine 1A. On the other hand, if the printing press motor 48 is driven to produce a printing press force of 5 kg against the opposite with a directive pulsed signal (X−10) in the case that the same stencil drum 16 is mounted on the stencil printing machine 1B, the deviation of −20 is determined as the machine body printing press correction value Tm of the stencil printing machine 1B. Also, if the printing press motor 48 is driven to produce a printing press force of 5 kg against the opposite with a directive pulsed signal (X+10) in the case that the same stencil drum 16 is mounted on the stencil printing machine 1C, the deviation of −20 is determined as the machine body printing press correction value Tm of the stencil printing machine 1C.

By the use of such printing press correction values, it is possible to prevent substantial printing quality variations among the respective stencil printing machines and the respective stencil drums since the identical printing environment is established for each combination of the stencil drum 16 and the stencil printing machine 1.

Figure 9:
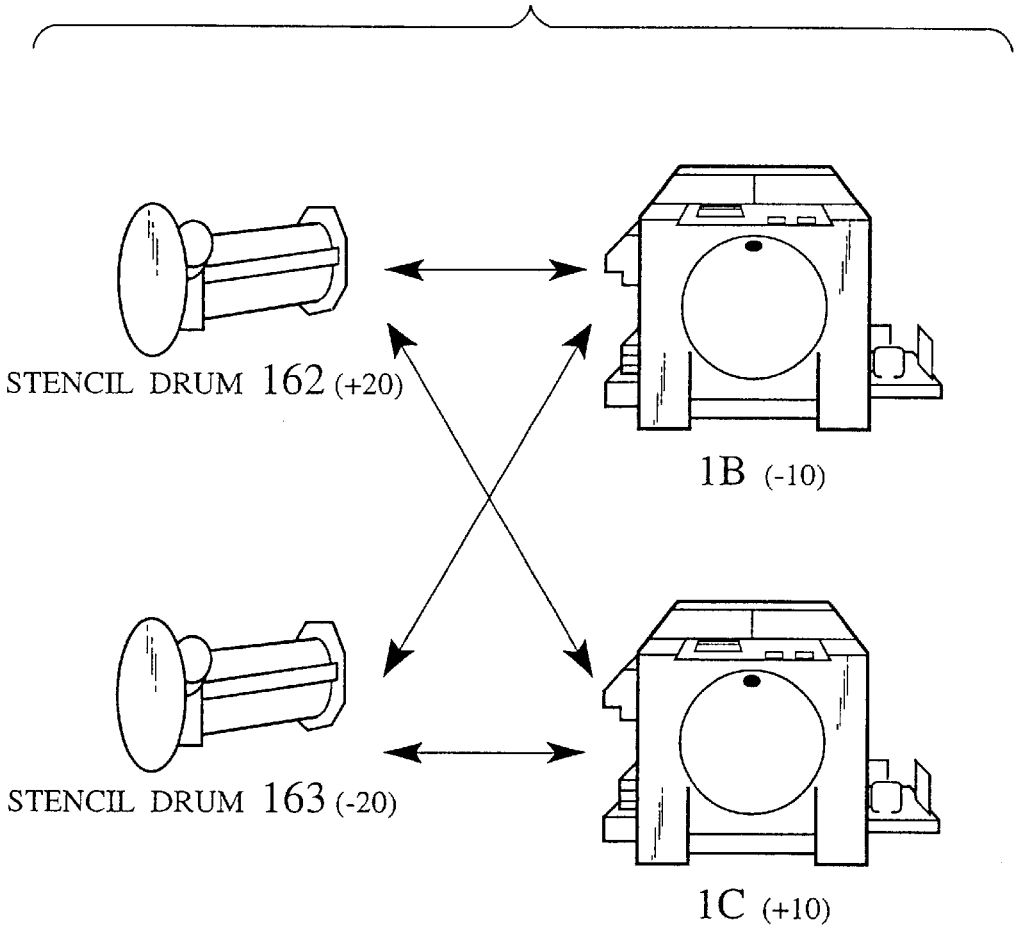
FIG. 9 is an explanatory view for explaining the stencil drum printing press correction value and the machine body printing press correction value in accordance with the embodiment of the present invention.

For example, as illustrated in FIG. 9, in the case that the stencil drum 162 (the stencil drum printing press correction value=+20) is mounted on the stencil printing machine 1B(the machine body printing press correction value=−10), the operation quantity of T can be obtained by adding the respective correction values Td and Tm to the standard operation quantity Tr(X) as obtained from the printing speed, the printing density and the temperature of the stencil drum, i.e., $$T=X(Tr)+20(Td)-10(Tm).$$

Also, in the case that the stencil drum 162 (the stencil drum printing press correction value=+20) is mounted on the stencil printing machine 1C(the machine body printing press correction value=+10), the operation quantity of T can be obtained as $$T=X(Tr)+20(Td)+10(Tm).$$

Furthermore, in the case that the stencil drum 163 (the stencil drum printing press correction value=−20) is mounted on the stencil printing machine 1B (the machine body printing press correction value=−10), the operation quantity of T can be obtained as $$T=X(Tr)-20(Td)-10(Tm).$$

Furthermore, in the case that the stencil drum 163 (the stencil drum printing press correction value=−20) is mounted on the stencil printing machine 1C (the machine body printing press correction value=+10), the operation quantity of T can be obtained as $$T=X(Tr)-20(Td)+10(Tm).$$

(Printing Control Process)

Figure 10:
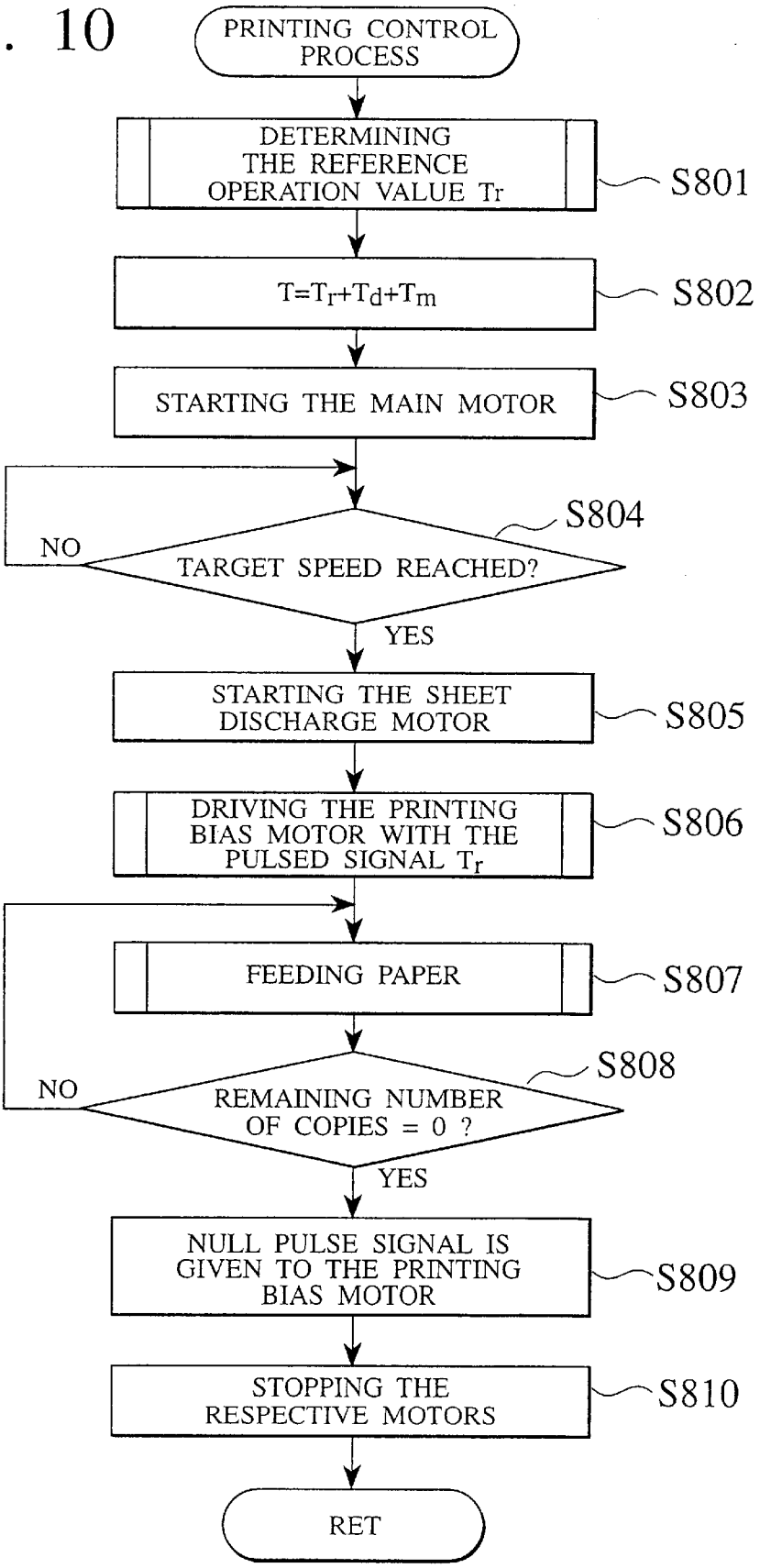
FIG. 10 is a flowchart showing the printing control process in accordance with the embodiment of the present invention.

Next, the process of controlling the stencil printing machine 1 for actually printing images will be explained. FIG. 10 is a flowchart showing the printing control process.

At the outset, when the printing control process is initiated, the standard operation quantity Tr is determined (S801). The determination of the standard operation quantity Tr is conducted with standard to the data table stored in the storage unit 103 on the basis of the values as set of the printing speed and the printing density and the temperature of the stencil drum when printing as described above. In this case, the stencil drum printing press correction value Td as stored in the storage unit 203 for the stencil drum is read out as well as the machine body printing press correction value Tm as stored in the storage unit 103.

Next, the operation quantity of T is calculated on the basis of the respective correction values Td and Tm (S802). Namely, as described above, the operation quantity of T is calculated by adding the stencil drum printing press correction value Td and the machine body printing press correction value Tm to the standard operation quantity Tr.

A main motor is then driven (S803) while a loop for wait is repeated to detect a target speed reached of the main motor (S804). After the speed of the main motor reaches the target speed, a sheet discharge motor begins rotating (S805), and the printing press motor 48 is driven with the pulsed signal corresponding to the operation quantity of T in order to adjust the printing press as applied.

A next sheet of paper is feed (S807) to continue the printing operation while judging whether or not the remaining number of sheets of paper for the current printing task is 0 (S808). The remaining number of the sheets to be printed is the desired number of copies as from which is subtracted the number of copies having been actually printed, and becomes 0 when the printed number reaches the desired number of copies. If the remaining number of the sheets to be printed is not 0, the paper is feed to continue the printing operation by the loop process. When the remaining number of the sheets to be printed becomes 0, null pulse signal is given to the printing press motor (S809) to stop the respective motors (S810) and terminate the printing operation.

Figure 11:
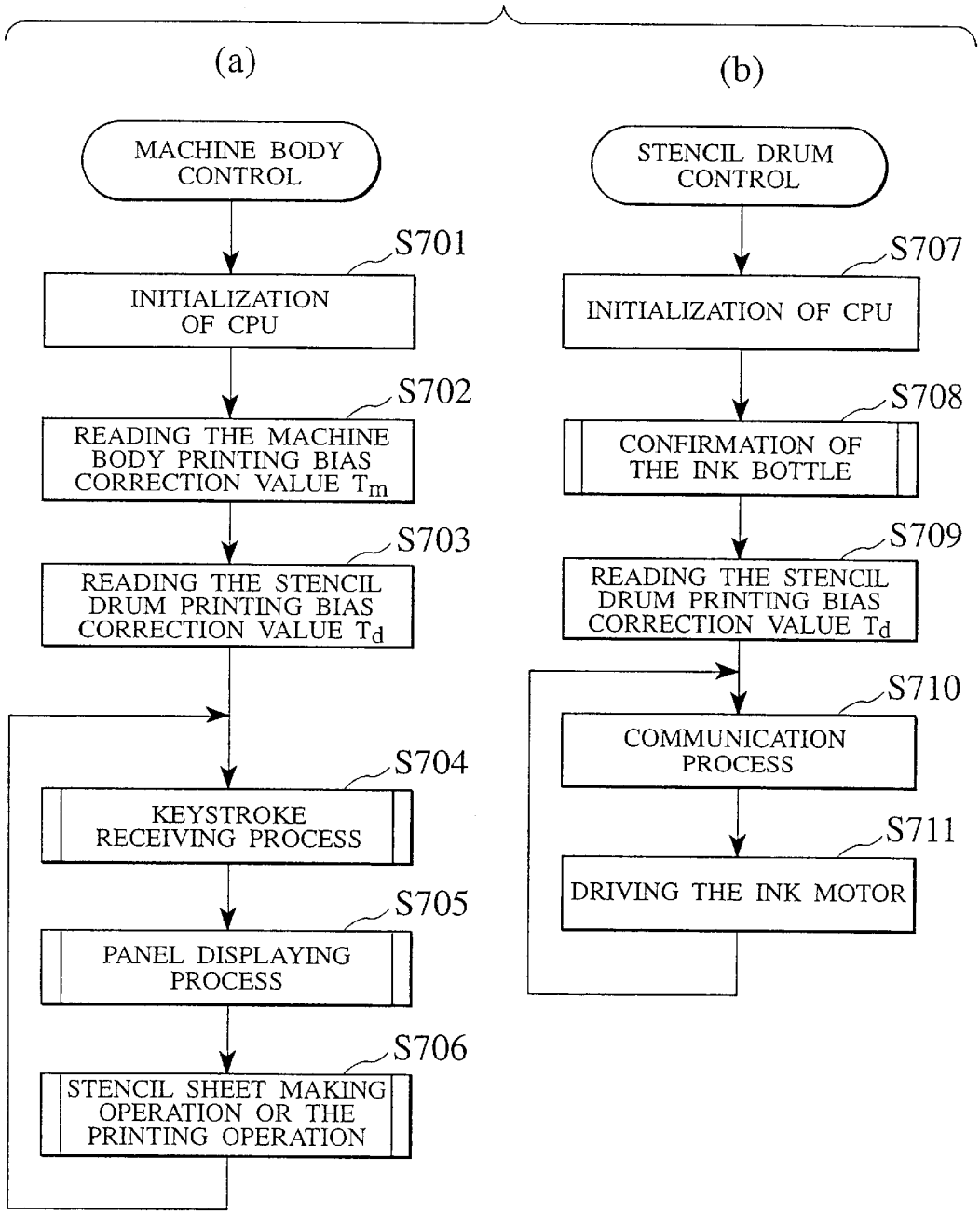
FIG. 11(*a*) is a flowchart showing the operation of the main control section of the machine body in accordance with the embodiment of the present invention.

During such a printing control process, the operation of the main control section 100 is performed as described in the following description. FIG. 11(*a*) is a flowchart showing the operation of the main control section 100.

As illustrated in the same figure, when the stencil printing machine 1 is powered up or when a new stencil drum 16 substitutes for the current stencil drum 16, the main control section 100 is operated to conduct initialization (S701). Next, the stencil drum printing press correction value Td is read out from the stencil drum 16 through the machine body/stencil drum communication units 104 and 212 while the machine body printing press correction value Tm is read out from the storage unit 103 and the like (S702,S703).

A keystroke receiving process is then conducted (S704), followed by a panel displaying process (S705) to initiate a stencil sheet making operation or the printing operation (S706). In this keystroke receiving process, the printing speed and the printing density required by a user can be obtained in order to determine the standard operation quantity Tr as explained heretofore in the step S801.

(The Operation of the Stencil Drum Control Section)

Next, the operation of the stencil drum control section 200 for the stencil drum 16 will be explained. FIG. 11(*b*) is a flowchart showing the operation of the stencil drum control section 200.

As illustrated in the same figure, when the stencil printing machine 1 is powered up or when a new stencil drum 16 substitutes for the current stencil drum 16, the main control section 200 is operated to conduct initialization (S707) and confirmation of the ink bottle (S708).

The stencil drum printing press correction value Td of the stencil drum 16 is then transferred to the machine body (S710). Namely, the stencil drum printing press correction value Td stored in the storage unit 203 is read out and transferred to the machine body/stencil drum communication unit 112 of the machine body through the machine body/stencil drum communication unit 212.

Next, communication processing is conducted (S710). Namely, in the machine body, the operation quantity of the printing press motor T is calculated by the use of the stencil drum printing press correction value Td transmitted from the stencil drum 16 and the like in order to adjust the printing press on the basis of the operation quantity of the printing press motor T as calculated. Furthermore, while indication of the printing operation is transmitted from the machine body to the stencil drum 16, the stencil drum 16 serves to control the ink motor in order to supply ink to the inside of the stencil drum 16 (S711).

Figure 12:
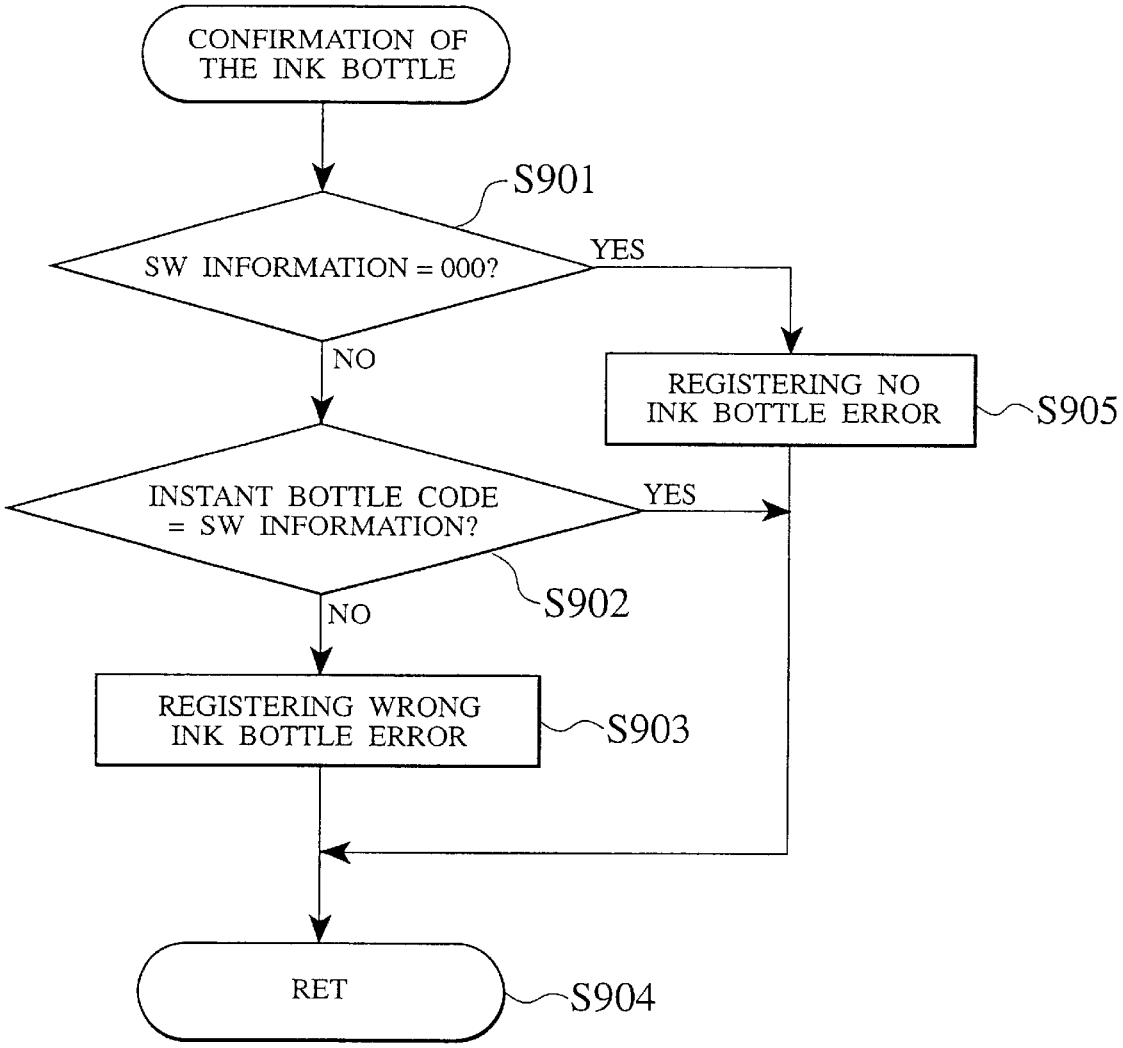
FIG. 12 is a flowchart showing the ink bottle confirmation process as the operation of the control unit of the stencil drum in accordance with the embodiment of the present invention.

The confirmation process of the ink bottle in the step S708 is conducted as described in the following explanation. FIG. 12 is a flowchart showing the operation of the confirmation process.

As illustrated in the same figure, it is judged whether or not SW information=000 (S901) in the course of the step S708 as described above. The SW information is information relating to the bottle set SW about the existence of the ink bottle as set in the stencil drum 16, the color of the ink bottle and so forth. In the case that the SW information=000, it is indicated that no ink bottle is set. Contrary to this, in the case that the SW information is not 000, it is indicated that an ink bottle is set.

In accordance with the present embodiment, in the case that the SW information=000, lack of an ink bottle is determined to register an error (S905) followed by terminating the process (S904). Namely, the error information indicative of lack of an ink bottle is registered in the machine body where a predetermined indication is displayed in the manipulation panel in accordance with the error information.

On the other hand, in the case that the SW information is not 000 in the step S901, the type of the ink bottle as set is determined (S902). Namely, it is judged whether or not the instant bottle code=the SW information (S902).

The instant bottle code SW is a code indicative of the type of ink and so forth as initialized or as set by a user. The instant bottle code SW is obtained from the machine body and stored in the RAM 201 and the like. It is indicated that the ink bottle as actually set is the ink bottle to be set in the case that the instant bottle code=the SW information, while it is indicated that the ink bottle as actually set is not the ink bottle to be set in the case that the instant bottle code is not the SW information.

In accordance with the present embodiment, when it is judged that the instant bottle code is not the SW information in the step S902, it is determined that a wrong ink bottle is set and an error is registered (S903) followed by terminating the process (S904). Namely, the error information indicative of a wrong ink bottle is registered in the machine body where a predetermined indication is displayed in the manipulation panel in accordance with the error information. On the other hand, when it is judged that the instant bottle code is the SW information in the step S902, the confirmation process of the ink bottle is terminated (S904) followed by the steps subsequent to the step S709.

(The Effects and Advantages of the Stencil Printing Machine)

In accordance with the configuration and the operation of the stencil printing machine 1 of the present embodiment as described above, it is possible to prevent the pressing force from varying with the respective stencil drums and/or the respective stencil printing machines due to dispersed characteristics which are caused by the dispersion of the accuracy of setting the stencil drum 16 and so forth. Namely, the printing press correction values Td and Tm as the information about the respective pressing forces of the current stencil drum and the machine body are stored in the storage unit 203 of the individual stencil drum and the storage unit 103 of the individual machine body and are used for adjusting the printing press as applied. It is therefore possible to prevent printed images from being lightened or darkened.

Furthermore, in accordance with the present embodiment, the standard operation quantity Tr indicative of the standard pressing force is determined for each of the respective correction values Td and Tm while the differential values therefrom are preset before shipping or set in the course of maintenance afterward, and used as correction values. It is therefore possible to prevent the printing press as applied from being dispersed due to the dispersion of the characteristics of the individual stencil printing machines and the individual stencil drums even when an arbitrary combination of one of the stencil printing machines and one of the stencil drums is used.

What is claimed is:

1. A stencil printing machine comprising a stencil drum and an opposite which are a pair of cylindrical parts located with their external peripheral surfaces being close to each other, a stencil sheet being detachably wound on the external peripheral surface of said stencil drum, and serving to perform a stencil printing process by rotating said stencil drum and said opposite in order that the external peripheral surfaces thereof are located close to each other and moved in the same direction while said stencil sheet is pressed against said opposite, and by making said stencil sheet in contact under pressure with a sheet of paper passing between said stencil drum and said opposite by the pressing force of said stencil drum, wherein a machine body of said stencil printing machine is provided with a machine body control section; and wherein said stencil drum is detachably mounted on said stencil printing machine and is provided with a stencil drum control section comprising:

a control unit, a storage unit connected to said control unit for storing information about a pressing force of said stencil drum against said opposite, and a machine body/stencil drum communication unit;

wherein said machine body/stencil drum communication unit of said stencil drum control section is in communication with said machine body control section for exchanging data between said machine body of said stencil printing machine and said stencil drum.

2. The stencil printing machine as claimed in claim 1 further comprising a memory connected to said control unit.

3. The stencil printing machine as claimed in claim 6 wherein said memory further comprises a RAM.

4. The stencil printing machine as claimed in claim 2 wherein said memory further comprises a ROM.

5. The stencil printing machine as claimed in claim 1 wherein said stencil drum control section further comprises a bottle set switch.

6. The stencil printing machine as claimed in claim 1 wherein said stencil drum control section further comprises a sensor.

7. A stencil printing machine comprising a stencil drum and an opposite which are a pair of cylindrical parts located with their external peripheral surfaces being close to each other, a stencil sheet being detachably wound on the external peripheral surface of said stencil drum, and serving to perform a stencil printing process by rotating said stencil drum and said opposite in order that the external peripheral surfaces thereof are located close to each other and moved in the same direction while said stencil sheet is pressed against said opposite, and by making said stencil sheet in contact under pressure with a sheet of paper passing between said stencil drum and said opposite by the pressing force of said stencil drum, wherein said stencil drum is detachably mounted on said stencil printing machine and is provided with a stencil drum control section; and wherein a machine body of said stencil printing machine is provided with a machine body control section comprising:

a control unit, a storage unit connected to said control unit for storing information about a pressing force of said stencil drum relative to said machine body, and a machine body/stencil drum communication unit;

wherein said machine body/stencil drum communication unit of said machine body control section is in communication with said stencil drum control section for exchanging data between said machine body of said stencil printing machine and said stencil drum.

8. The stencil printing machine as claimed in claim 2 further comprising a memory connected to said control unit.

9. The stencil printing machine as claimed in claim 8 wherein said memory further comprises a RAM.

10. The stencil printing machine as claimed in claim 8 wherein said memory further comprises a ROM.

11. The stencil printing machine as claimed in claim 7 wherein said machine body control section further comprises an input/output panel.

12. A stencil printing machine comprising a stencil drum and an opposite which are a pair of cylindrical parts located with their external peripheral surfaces being close to each other, a stencil sheet being detachably wound on the external peripheral surface of said stencil drum, and serving to perform a stencil printing precess by rotating said stencil drum and said opposite in order that the external peripheral surfaces thereof are located close to each other and moved in the same direction while said stencil sheet is pressed against said opposite, and by making said stencil sheet in contact under pressure with a sheet of paper passing between said stencil drum and said opposite by the pressing force of said stencil drum, wherein said stencil drum is detachably mounted on said stencil printing machine and is provided with a first storage unit for storing information about a pressing force of said stencil drum against said opposite, and wherein a machine body of said stencil printing machine is provided with a second storage unit for storing information about a pressing force of said stencil drum relative to said machine body, wherein said stencil printing machine further comprises:

a standard pressing force determination unit for determining a standard pressing force;

a correction value calculation unit for calculating a correction value by the use of the information about the pressing force as stored in said first storage unit of said stencil drum and the information about the pressing force as stored in said second storage unit of said machine body; and a calculation unit for calculating the pressing force by the use of said standard pressing force and said correction value.

13. A stencil print ing machine comprising a stencil drum and an opposite which are a pair of cylindrical parts located with their external peripheral surfaces being close to each other, a stencil sheet being detachably wound on the external peripheral surface of said stencil drum, and serving to perform a stencil printing precess by rotating said stencil drum and said opposite in order that the external peripheral surfaces thereof are located close to each other and moved in the same direction while said stencil sheet is pressed against said opposite, and by making said stencil sheet in contact under pressure with a sheet of paper passing between said stencil drum and said opposite by the pressing force of said stencil drum, wherein said stencil drum is detachably mounted on said stencil printing machine and is provided with a stencil drum control section for controlling an operational value of a pressing force to be exerted on said stencil drum against said opposite, said control section comprising:

a control unit;

a standard operational quantity storage unit for storing a standard operational quantity, determined based on a printing speed, a printing density and a temperature of said stencil drum, of said stencil drum relative to said opposite, a correction value storage unit for storing a drum correction value related to said stencil drum and said stencil printing machine; and a calculation unit for calculating the operational value of said pressing force as a function of said standard operational quantity and said drum correction value.

14. A stencil printing machine comprising a stencil drum and an opposite which are a pair of cylindrical parts located with their external peripheral surfaces being close to each other, a stencil sheet being detachably wound on the external peripheral surface of said stencil drum, and serving to perform a stencil printing precess by rotating said stencil drum and said opposite in order that the external peripheral surfaces thereof are located close to each other and moved in the same direction while said stencil sheet is pressed against said opposite, and by making said stencil sheet in contact under pressure with a sheet of paper passing between said stencil drum and said opposite by the pressing force of said stencil drum, wherein said stencil drum is detachably mounted on said stencil printing machine and wherein a machine body of said stencil printing machine is provided with a machine body control section for controlling a pressing force to be exerted to said stencil drum against said opposite, said control section comprising:

a control unit;

a standard operational quantity storage unit for storing a standard operational quantity, determined based on a printing speed, a printing density and a temperature of said stencil drum, of said stencil drum relative to said machine body, a correction value storage unit for storing a machine body correction value related to said machine body and said stencil drum installed therein; and a calculation unit for calculating the operational value of said pressing force as a function of said standard operational quantity and said machine body correction value.

15. A method for controlling an operational value of a pressing force to be exerted to a stencil drum relative to an opposite both of which are installed in a stencil printing machine, said method comprising the steps of:

inputting into a standard operational quantity storage unit a standard operational quantity, determined based on a printing speed, a printing density and a temperature of said stencil drum, of said stencil drum relative to said opposite;

inputting into a correction value storage unit a drum correction value corresponding to said stencil drum and said opposite; and calculating the operational value of said pressing force as a function of the standard operational quantity and the drum correction value.

16. A method for controlling an operational value of a pressing force to be exerted to a stencil drum installed in a machine body of a stencil printing machine which has a machine body control section, said method comprising the steps of:

inputting into a standard operational quantity storage unit of said machine body control section a standard operational quantity, determined based on a printing speed, a printing density and a temperature of said stencil drum, of said stencil drum relative to said machine body;

inputting into a correction value storage unit of said machine body control section a drum correction value related to said stencil drum and said machine body; and calculating the operational value of said pressing force as a function of said standard operational quantity and said drum correction value.

17. A method for controlling an operational value of a pressing force to be exerted to a stencil drum of a stencil printing machine, said method comprising the steps of:

inputting into a correction value calculation unit a drum correction value corresponding to a printing drum installed in the stencil printing machine;

inputting into said correction value calculation unit a machine body correction value;

calculating a pressing force correction value as a function of the drum correction value and the machine body correction value; and calculating the operational value of the pressing force as a function of the pressing force correction value and a standard pressing force.

* * * * *

UNITED STATES PATENT AND TRADEMARK OFFICE

CERTIFICATE OF CORRECTION

PATENT NO. : 6,484,630 B2
DATED : November 26, 2002
INVENTOR(S) : Nakayama et al.

It is certified that error appears in the above-identified patent and that said Letters Patent is hereby corrected as shown below:

Column 13,
Line 13, change "6" to -- 2 --.
Line 52, change "2" to -- 8 --.

Signed and Sealed this

Eighteenth Day of March, 2003

JAMES E. ROGAN
*Director of the United States Patent and Trademark Office*